US008215369B1

(12) United States Patent
Kelley

(10) Patent No.: US 8,215,369 B1
(45) Date of Patent: Jul. 10, 2012

(54) SANDWICHED GARAGE DOOR PANEL

(76) Inventor: Robert A. Kelley, Moreno Valley, CA (US)

( * ) Notice: Subject to any disclaimer, the term of this patent is extended or adjusted under 35 U.S.C. 154(b) by 0 days.

(21) Appl. No.: 12/802,005

(22) Filed: May 26, 2010

(51) Int. Cl.
*E06B 3/12* (2006.01)

(52) U.S. Cl. ..... 160/236; 160/232; 52/784.05

(58) Field of Classification Search ..... 160/201, 160/236; 52/309.16
See application file for complete search history.

(56) References Cited

U.S. PATENT DOCUMENTS 5,177,868 A * 1/1993 Kyle et al. ..... 29/897.32
5,445,208 A * 8/1995 Shaner et al. ..... 160/232
6,047,761 A * 4/2000 Jaehnen et al. ..... 160/201
6,626,226 B2 * 9/2003 Whitley ..... 160/236
7,730,928 B2 * 6/2010 Stone et al. ..... 160/201
2005/0016694 A1 * 1/2005 Jella ..... 160/236
2007/0193704 A1 * 8/2007 Brown, Jr. et al. ..... 160/201

* cited by examiner

*Primary Examiner* — Blair M. Johnson
(74) *Attorney, Agent, or Firm* — Thomas I. Rozsa

(57) ABSTRACT

An improved sandwiched garage door panel. The first improvement is that the rear covering skin is made of 25 point embossed wood grain polyboard which is much less expensive than steel so that the cost of manufacture of the panel is significantly reduced. The second improvement is the creation of a channel within the central foam core of the panel with at least one and preferably two steel plates retained within the channel. As a result, a mounting plate of the hinge assembly which interconnects two adjacent panels can be affixed to the steel plate and thereafter the rear covering plate is affixed to the foam core to thereby conceal the mounting plate resulting in a more attractive garage door panel.

14 Claims, 5 Drawing Sheets

SANDWICHED GARAGE DOOR PANEL

BACKGROUND OF THE INVENTION

1. Field of the Invention

The present invention relates to panels which are used to form garage doors wherein the various panel sections are hinged together to enable the garage door to rotate along tracks on either side of the garage door to be retracted adjacent the ceiling in order for the garage to be opened and then rotated back down so that the bottom of the entire garage door rests against the ground when the garage is closed. The present invention relates to the specific construction of the individual panels which are used to form the entire garage door.

2. Detailed Description of the Prior Art

To the best of the present inventor's knowledge, the prior art garage door panels which are related to the present invention are formed in the following way. They are known as sandwich doors which have a front skin usually made of 24 to 27 gauge steel and a rear skin also having 24 to 27 gauge steel and foam sandwiched between the two sections of steel. The foam material is expanded polystyrene E.P.S. and is usually 1⅞" to two inches thick so that it is referred to as a two inch sandwich steel door. The length of the E.P.S. polystyrene is very important and it should be noted that it is as long as the door sections, i.e. 8 ft., 9 ft. 16 ft., 18 ft. etc. Full length solid pieces provide more strength than using multiple pieces in a section. The 2 inch sandwich steel door is the most widely used insulated door in the garage door industry. It should be noted that 1⅜" thick steel sandwich doors are also used in the garage door industry.

A problem with the prior art garage door panels is that it is more expensive to have pre-painted steel on both the front and rear of the sandwich door assembly and when one panel is hinged to another panel, the panel hinges must necessarily be through the steel backing so that it is not visible from the outside. There is a significant need for an improved garage door panel where the cost of the manufacturing of the panel is reduced and where the unsightly hinge stile/hinge backup plate can also be concealed yet is retained in a strong manner so that it can enable one section to be rotated relative to a second section as the garage door is retracted and then returned to its position adjacent the ground.

It should be noted that currently manufactured poly/vinyl insulated doors are standard pan type. They are not insulated before assembly. They are post insulated with multiple pieces of pre-laminated E.P.S. sheet foam. This gives no strength to the door section. In addition to squeaking and loose fitting multi-piece construction, the unsightly door and hinge center support stiles are exposed.

Therefore, there is a need for an improved garage door assembly which addresses the above discussed problems.

SUMMARY OF THE INVENTION

The present invention is an improved sandwiched garage door panel. The first improvement is that the rear covering skin is made of 25 point embossed wood grain texture polyboard which is much less expensive than steel so that the cost of manufacture of the panel is significantly reduced. It should be noted that thicker or thinner polyboard could be substituted for manufacturing purposes. The second improvement is the 25 point woodgrain embossed polyboard which provides a significant weight reduction. Less total door weight allows for a reduction in spring size, door track and hinge thickness. This reduction allows for even more cost savings resulting in a less expensive insulated door. The third improvement is the creation of a channel within the central foam E.P.S. core of the panel with at least one, and preferably two, steel plates retained within the channel. As a result, a mounting plate of the hinge assembly which interconnects two adjacent panels can be affixed to the steel plate and thereafter the rear covering (25 point embossed wood grain texture polyboard) is bonded to the foam core to thereby conceal the mounting plate, resulting in a more attractive interior garage door panel.

It is therefore an object of the present invention to reduce the cost of the garage door panel and weight by replacing a rear steel covering skin with a 25 point embossed wood grain polyboard.

It is a further object of the present invention to provide a mechanism that runs the full height of the section, the mounting plate of the hinge assembly which interconnects two adjacent garage door panels that are concealed to thereby significantly improve the appearance of the inside of the garage door panel.

Further novel features and other objects of the present invention will become apparent from the following detailed description, discussion and the appended claims, taken in conjunction with the drawings.

DRAWING SUMMARY

Referring particularly to the drawings for the purposes of illustration only and not limitation therein is illustrated:

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
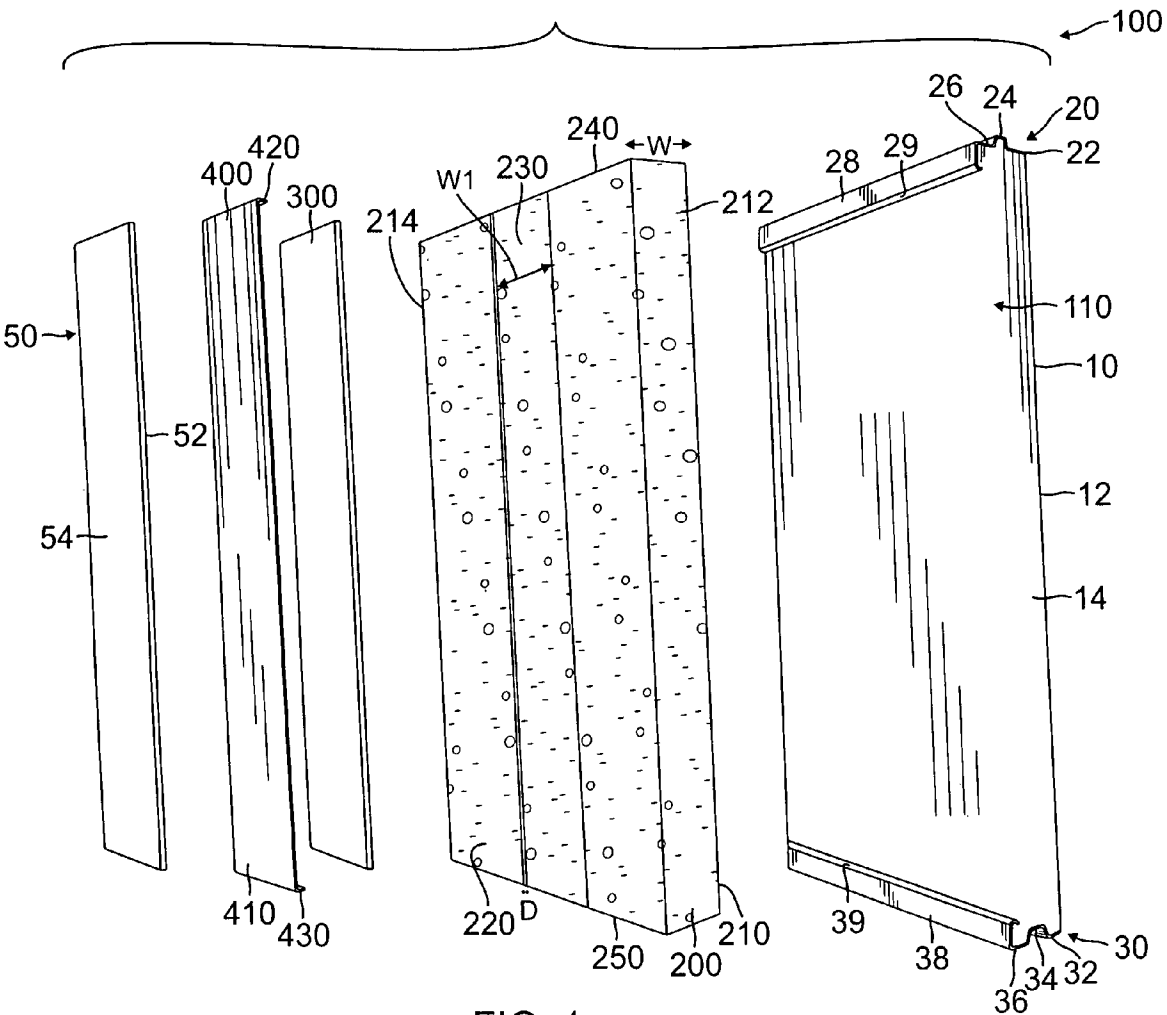
FIG. 1 is an exploded view of the present invention improved sandwich garage door panel illustrating the components of the sandwich door panel without the hinge assembly.

FIG. 1 is an exploded view of the present invention improved sandwich garage door. The entire assembly of the present invention garage door is labeled as 100. The first section of the present invention garage door consists of a front steel skin 10 which is usually 24 gauge to 27 gauge steel. Because of the improvement as will be described in the present invention, the present invention can utilize 24 gauge to 27 gauge steel which is less expensive and lighter weight than 24 gauge steel. The front section 10 extends into an upper interlocking section 20 which consists of a first horizontal section 22, a vertically orientated male interlocking section 24, a second horizontal section 26 and then a lower vertically orientated rear section 28. Rear section 28 extends to an inwardly facing horizontal surface 29. The lower portion of the front steel skin extends into a lower interlocking section 30 which includes a first horizontal section 32, a female interior section 34, a second horizontal section 36 and then a lower vertical section 38 which is aligned and parallel to the upper vertical section 28. Rear section 38 extends to an inwardly extending lower surface 39.

The front steel surface 10 has a front surface 12 and a rear surface 14. An interior gap or chamber 110 is located behind the rear surface 14 of front skin 10 and rests between the upper interlocking section 20 and the lower interlocking section 30. Inserted into this gap is a 2 inch foam core 200 which by way of example can be made of expanded polystyrene EPS. By way of example only, the width "W" of the foam core can be approximately 2 inches. In prior art foam cores, the foam core consists of a solid rectangular piece of material.

An improvement of the present invention is to cut a lengthwise channel into the foam core. The foam core has a front side 210 which is smooth. The foam core has a first side wall 212 and a second opposed parallel side wall 214 which are also solid. The rear surface 220 has the improvement of the present invention. A channel 230 is formed in the rear surface 220 and extends from the top 240 to the bottom 250 of the foam core and extends inwardly for a depth "D" of approximately a quarter of an inch. The channel can have a width W1 of anywhere from two inches to four inches. Inserted into the panel is a first rectangular piece of galvanized steel 300 which is shaped to fit within the channel 230 and extend from the top surface 240 to the bottom surface 250 of the foam. The rectangular piece of galvanized steel can by way of example be 24 gauge steel. Then inserted above the 24 gauge steel panel is a second galvanized steel panel 400 which also can be made of 24 gauge galvanized steel having a rectangular body 410 which terminates an upper transverse section 420 which extends perpendicular to the body 410 and a lower transverse section 430 which extends perpendicular to the body 410. The rectangular plate 300 is placed into the channel 230 and then the second rectangular steel plate 400 is placed over the first rectangular steel plate so that the upper transverse section 420 is sandwiched between the top 240 of the foam core and the transverse upper interior surface 29 of the upper interlocking section or tongue and groove mating section 20 and the lower transverse section 430 of the steel plate is sandwiched between the bottom of the foam core 250 and the lower interior transverse surface 39 of lower interlocking section or tongue and groove section 30. Because of the sandwiching effect, the metal plate 400 is firmly held against the interior plate 300 and also is firmly held within the foam core.

Figure 2:
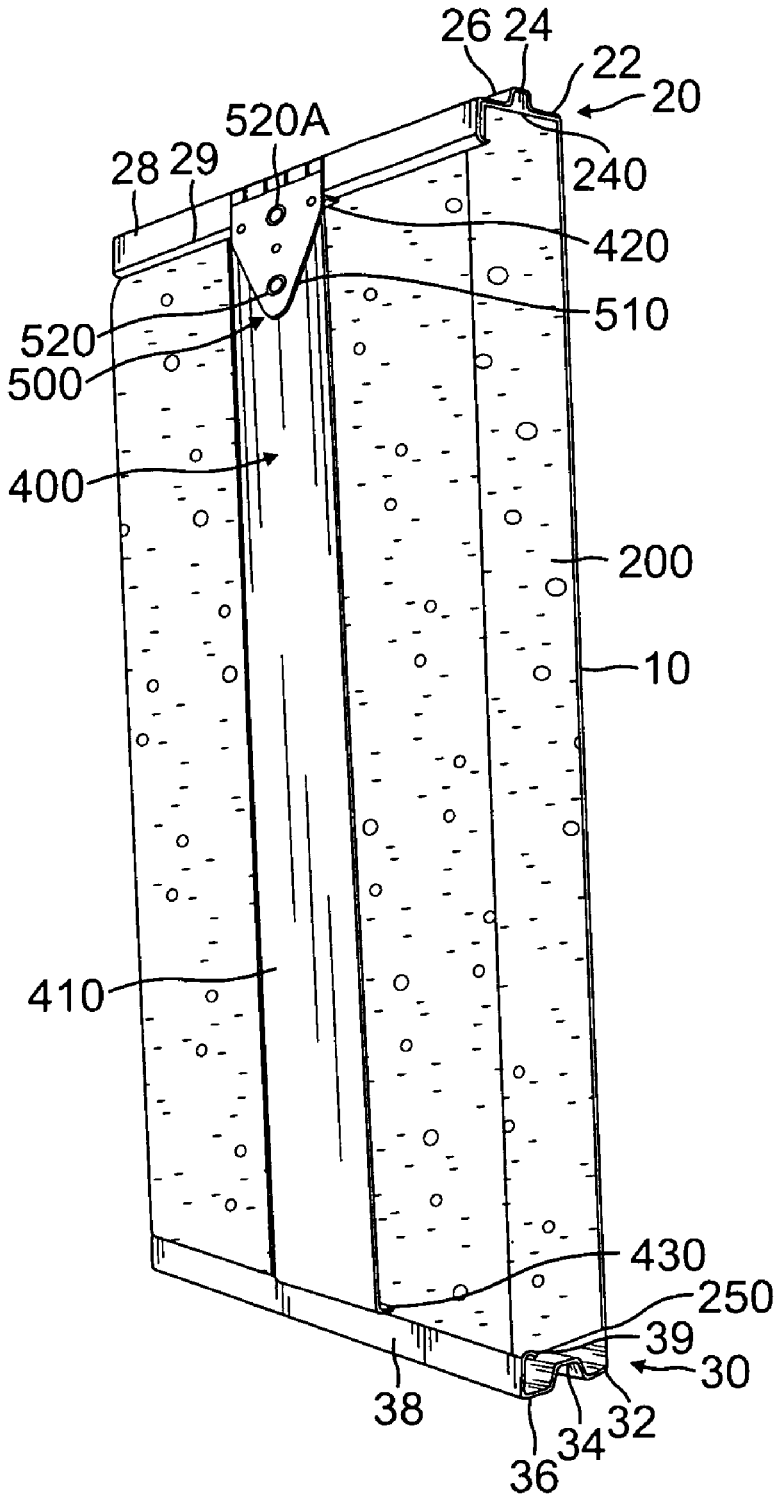
FIG. 2 is a perspective view of the assembled garage door panel with the back cover and end caps removed.

Referring to FIG. 2, there is illustrated the structure as just described in the assembled condition before the rear sheet is placed over back surface 220 of the foam core 200. As illustrated in FIG. 2, the foam core 200 is sandwiched in the gap 110 and is press fit between the tongue and grove sections 20 and 30 and resting between the rear surface 14 of front steel plate 10 and between the interior of vertical surfaces 28 and 38 of respective tongue and groove sections 20 and 30. Also illustrated is a lower section of a hinge assembly 500 which has a connecting plate 510 which is affixed to the metal plate 400 by various fastener members 520, 520*a*, etc. which can be fastening screws which are fastened and screwed into the metal plate 400 and also extend to interior metal plate 300. This is a significant improvement in the present invention because in the prior art, it was necessary to have the hinges affixed to the rear plates or front plates of the sandwich door sections where the plates were clearly visible. Through use of the present invention, the fastening portions of the hinge are concealed within the garage door panel because the hinge can be affixed to the center metal sections 400 and 300 in the center of the panel. After the hinge is affixed in this manner, another significant improvement of the present invention is the rear covering surface 50 of the present invention garage door assembly. In the prior art, the rear surface of the sandwich garage door also consisted of metal which included 24 gauge or 26 gauge steel. The innovation is that on the back section 50 of the sandwich door assembly 100 instead of a steel skin, the present invention substitutes therefore a composite which consists of 25 point embossed wood grain polyboard having a front surface 52 and a rear surface 54. The front surface 52 of the polyboard 50 is laminated to the rear surface 220 of the foam with a PUR urethane or hot melt glue. Also, for purposes of security, the front surface 210 of the foam core 200 is also laminated to the interior surface 14 of the front steel skin 10 with PUR urethane. In the present invention, the rear polyboard 50 is laminated to the back of the surface 220 of the foam core 200 but does not extend over the rear surfaces 28 and 38 of the upper and lower tongue and groove sections. In the prior art, the steel skin did extend over these sections with a 90 degree bend.

Figure 3:
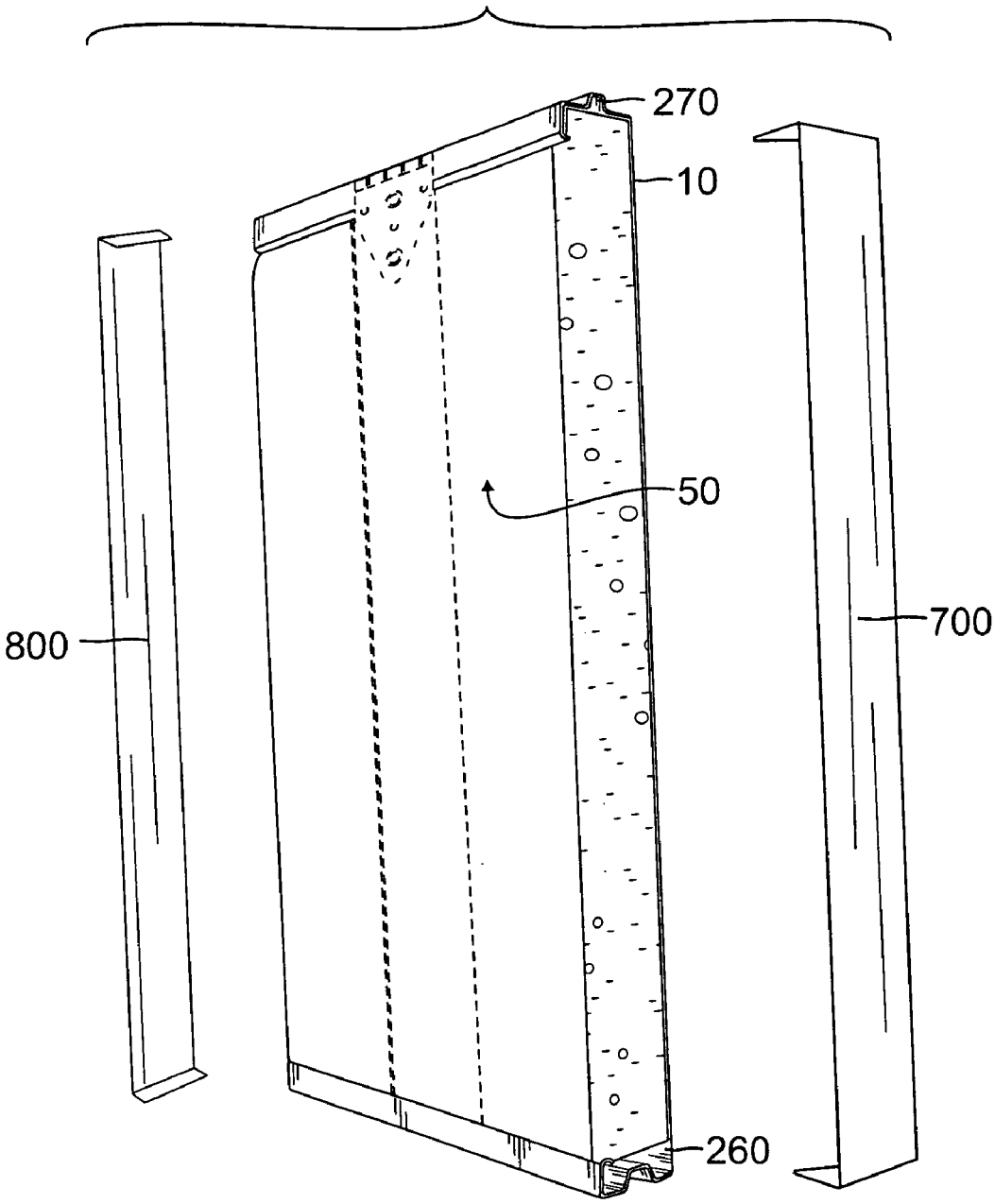
FIG. 3 is a perspective and partially exploded view illustrating the assembled garage door panel with the end caps removed.
Figure 4:
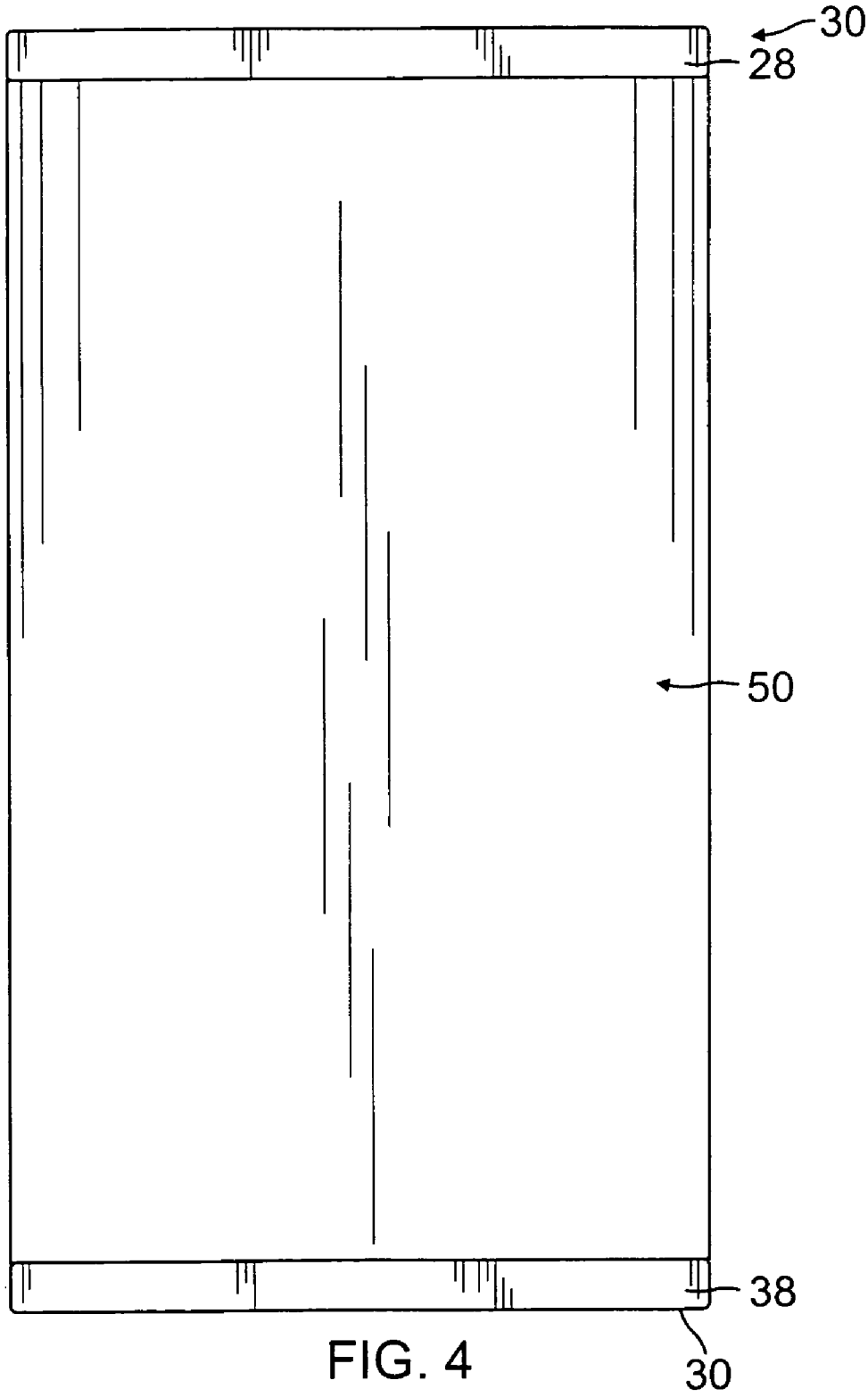
FIG. 4 is a rear elevational view of the present invention garage door panel.

The fully assembled panel is illustrated in FIG. 3. In addition to the foam core 200, before final assembly, a lower foam core 260 is inserted into the lower channel of the lower tongue and groove section 30 and an upper foam core 270 is inserted into the upper tongue and groove section 20. End cap 700 covers side 212 of foam core 200 and end cap 800 covers side 214 of foam core 200. As a result, the panel is now completely enclosed but the improvements are that the hinge section is now concealed by the rear 25 point wood grain embossed poly board 50 of the present invention and the rear skin is much less expensive than using a steel skin as in the prior art. The rear surface of the completed garage door panel is illustrated in FIG. 4 which shows that poly board 50 covers the rear of the panel but extend only up to the lower end of the vertical section 28 of the upper tongue and groove section 20 and the upper end of the vertical section 38 of the lower tongue and groove portion 30 of the garage door assembly 100.

Figure 5:
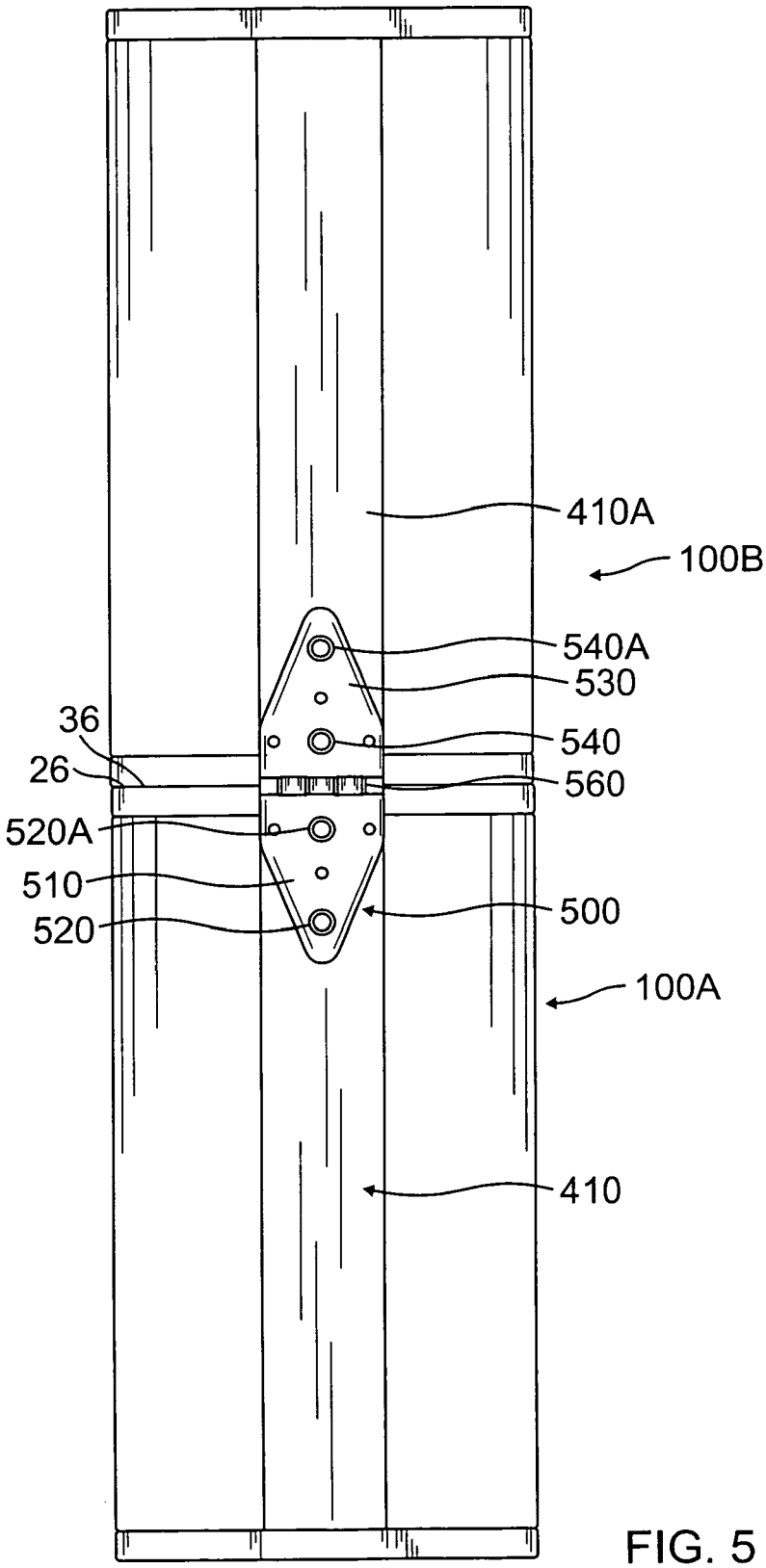
FIG. 5 is a rear elevational view of two adjacent garage door panels with the rear covers removed to illustrate the mechanism by which two panels are connected by hinges which are affixed to the interior middle sections within the channels of the foam core.

In operation, one panel is affixed adjacent another panel so that the male tongue portion 24 extends into the female groove portion 34 of an adjacent panel. The panels are hinged together. Referring to FIG. 5, there is shown a view with the rear surface of the panels removed for purposes of illustration to show how the hinge assembly is affixed from one panel to an adjacent panel. The hinge assembly 500 has the lower plate 510 as already discussed affixed by fastener members 520 and 520A to the rear surface 410 of metal plate 400 and also through metal plate 300 of first or lower panel 100A. The second or upper panel 100B has the same construction as 100A and the second portion of the hinge plate 530 is fastened to the rear surface 410A of a rectangular metal plate and an interior plate of the upper panel 100B by fastener members 540 and 540A which also can be screws. After the rotatable hinge 560 is aligned at the intersection between the upper surface 26 of the lower panel and the lower surface 36 of the upper panel, that the tongue and groove assembly can fit so that the two panels are aligned when the garage door is in a vertical orientation and the door is in the closed position. The panels can rotate slightly relative to each other by means of the hinge 560 as the garage door rotates up a track to retract adjacent the ceiling for opening of the garage door. After the hinge assembly is assembled as illustrated in FIG. 5, the rear polyboard 50 assembly as illustrated in FIGS. 3 and 4 is placed over the rear surface 220 of the foam and affixed thereto as previously discussed so that the connecting plates 510 and 530 of the hinge are concealed to make for a much more attractive appearance.

Therefore, through use of the present invention, the present invention has a rear surface having only a 25 point embossed wood grain polyboard which is therefore much less expensive than having a rear steel skin and also has an interior metal plate to which the hinge is fastened so that the hinge is concealed.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A garage door panel comprising:

a. a front steel cover skin having a front section which extends at one end to an upper interlocking section which includes a first horizontal section, a vertically orientated male interlocking section, a second horizontal section and then a lower vertical rear section which extends to an inwardly extending upper horizontal surface, the front section also extends at its opposite end to a lower interlocking section which includes a first horizontal section, a female interior section, a second horizontal section and then a lower vertical section which extends to an inwardly extending lower horizontal surface b. the front steel covering skin having a front surface and a rear surface, an interior chamber located behind the rear surface of the front steel covering skin and extends between the upper interlocking section and the lower interlocking section;

c. a foam core located within the chamber and having a front surface, a rear surface, a top surface, a bottom surface and parallel opposite side surfaces, a lengthwise channel having a given width and depth formed into the rear surface of the foam core, a first galvanized steel plate retained within the channel and a second galvanized steel plate having a rectangular body which terminates in an upper transverse section which extends perpendicular to the body and a lower transverse section which extends perpendicular to the body, the second steel plate placed over the first steel plate so that the upper transverse section is sandwiched between the top of the foam core and the inwardly extending upper horizontal surface of the upper interlocking section and the lower transverse section is sandwiched between the bottom of the foam core and the inwardly extending lower horizontal surface of lower interlocking section so that second steel plate is firmly held against the first steel plate and is also firmly held within the foam core;

d. a hinge assembly including a hinge and a mounting plate, the mounting plate affixed by fastening means to the second steel plate so that the hinge rests at a location adjacent a horizontal surface of an interlocking section; and e. a rear covering skin made of 25 point embossed wood grain polyboard having a front surface and a rear surface, the front surface affixed to the rear surface of the foam core to thereby conceal the mounting plate of the hinge assembly.

2. The garage door panel in accordance with claim 1 wherein the front surface of the rear cover skin is affixed to the rear surface of the foam core by a PUR urethane or hot melt glue.

3. The garage door panel in accordance with claim 1 wherein the front surface of the foam core is laminated to the interior surface of the front steel skin with a PUR urethane.

4. The garage door panel in accordance with claim 1 wherein the channel in the rear surface of the foam core is centered at a location between opposite sidewalls of the foam core and extends from the top surface of the foam core to the bottom surface of the foam core.

5. The garage door panel in accordance with claim 1 wherein the front steel covering skin is made out of 26 gauge steel.

6. The garage door panel in accordance with claim 1 wherein each side surface of the foam core is respectively covered by an end cap.

7. The garage door panel in accordance with claim 1 wherein each side surface of the foam core is respectively covered by an end cap.

8. A pair of garage door panels comprising:

a. a first garage door panel having:

(i) a front steel cover skin having a front section which extends at one end to an upper interlocking section which includes a first horizontal section, a vertically orientated male interlocking section, a second horizontal section and then a lower vertical rear section which extends to an inwardly extending upper horizontal surface, the front section also extends at its opposite end to a lower interlocking section which includes a first horizontal section, a female interior section, a second horizontal section and then a lower vertical section which extends to an inwardly extending lower horizontal surface;

(ii) the front steel covering skin having a front surface and a rear surface, an interior chamber located behind the rear surface of the front steel covering skin and extends between the upper interlocking section and the lower interlocking section;

(iii) a foam core located within the chamber and having a front surface, a rear surface, a top surface, a bottom surface and parallel opposite side surfaces, a lengthwise channel having a given width and depth formed into the rear surface of the foam core, a first galvanized steel plate retained within the channel and a second galvanized steel plate having a rectangular body which terminates in an upper transverse section which extends perpendicular to the body and a lower transverse section which extends perpendicular to the body, the second steel plate placed over the first steel plate so that the upper transverse section is sandwiched between the top of the foam core and the inwardly extending upper horizontal surface of the upper interlocking section and the lower transverse section is sandwiched between the bottom of the foam core and the inwardly extending lower horizontal surface of lower interlocking section so that the second steel plate is firmly held against the first steel plate and is also firmly held within the foam core;

(iv) a hinge assembly including a hinge and a first mounting plate, the first mounting plate affixed by fastening means to the second steel plate so that the hinge rests at a location adjacent a horizontal surface of the upper interlocking section;

(v) a rear covering skin made of 25 point embossed wood grain polyboard having a front surface and a rear surface, the front surface affixed to the rear surface of the foam core to thereby conceal the mounting plate of the hinge assembly;

b. a second garage door panel having:

(i) a front steel cover skin having a front section which extends at one end to an upper interlocking section which includes a first horizontal section, a vertically orientated male interlocking section, a second horizontal section and then a lower vertical rear section which extends to an inwardly extending upper horizontal surface, the front section also extends at its opposite end to a lower interlocking section which includes a first horizontal section, a female interior section, a second horizontal section and then a lower vertical section which extends to an inwardly extending lower horizontal surface;

(ii) the front steel covering skin having a front surface and a rear surface, an interior chamber located behind the rear surface of the front steel covering skin and extends between the upper interlocking section and the lower interlocking section;

(iii) a foam core located within the chamber and having a front surface, a rear surface, a top surface, a bottom surface and parallel opposite side surfaces, a lengthwise channel having a given width and depth formed into the rear surface of the foam core, a first galvanized steel plate retained within the channel and a second galvanized steel plate having a rectangular body which terminates in an upper transverse section which extends perpendicular to the body and a lower transverse section which extends perpendicular to the body, the second steel plate placed over the first steel plate so that the upper transverse section is sandwiched between the top of the foam core and the inwardly extending upper horizontal surface of the upper interlocking section and the lower transverse section is sandwiched between the bottom of the foam core and the inwardly extending lower horizontal surface of lower interlocking section so that the second steel plate is firmly held against the first steel plate and is also firmly held within the foam core;

(iv) the hinge assembly including a second mounting plate affixed by fastening means to the second steel plate so that the hinge rests at a location adjacent a horizontal surface of the lower interlocking section;

(v) a rear covering skin made of 25 point embossed wood grain polyboard having a front surface and a rear surface, the front surface affixed to the rear surface of the foam core to thereby conceal the mounting plate of the hinge assembly; and c. the vertically oriented male interlocking section of the upper interlocking section of the first garage door panel inserted into the female interior section of the lower interlocking section of the second garage door panel with the hinge positioned so that the second panel will rotate relative to the first panel.

9. A garage door panel comprising:

a. a front steel cover skin having a front section which extends at one end to an upper interlocking section which includes at least a male interlocking section, a rear horizontal section and then a lower vertical rear section which extends to an inwardly extending upper horizontal surface, the front section also extends at its opposite end to a lower interlocking section which includes at least a female interior section, a rear horizontal section and then a lower vertical section which extends to an inwardly extending lower horizontal surface;

b. the front steel covering skin having a front surface and a rear surface, an interior chamber located behind the rear surface of the front steel covering skin and extends between the upper interlocking section and the lower interlocking section;

c. a foam core located within the chamber and having a front surface, a rear surface, a top surface, a bottom surface and parallel opposite side surfaces, a lengthwise channel having a given width and depth formed into the rear surface of the foam core, at least one steel plate having a body which terminates in an upper transverse section which extends perpendicular to the body and a lower transverse section which extends perpendicular to the body, the upper transverse section is sandwiched between the top of the foam core and the inwardly extending upper horizontal surface of the upper interlocking section and the lower transverse section is sandwiched between the bottom of the foam core and the inwardly extending lower horizontal surface of lower interlocking section so that the steel plate is firmly retained within the channel;

d. a hinge assembly including a hinge and a mounting plate, the mounting plate affixed by fastening means to the at last one steel plate retained within the channel of the foam core so that the hinge rests at a location adjacent a horizontal surface of an interlocking section; and e. a rear covering skin made of 25 point embossed wood grain polyboard having a front surface and a rear surface, the front surface affixed to the rear surface of the foam core to thereby conceal the mounting plate of the hinge assembly.

10. The garage door panel in accordance with claim 8 wherein the front surface of the rear cover skin is affixed to the rear surface of the foam core by a PUR urethane or hot melt glue.

11. The garage door panel in accordance with claim 9 wherein the front surface of the foam core is laminated to the interior surface of the front steel skin with a PUR urethane or hot melt glue.

12. The garage door panel in accordance with claim 9 wherein the channel in the rear surface of the foam core is centered at a location between opposite sidewalls of the foam core and extends from the top surface of the foam core to the bottom surface of the foam core.

13. The garage door panel in accordance with claim 9 wherein the front steel covering skin is made out of 26 gauge steel.

14. The garage door assembly in accordance with claim 9 further comprising a second steel plate retained within the channel of the foam core and located between the foam core and the at least one steel plate.

* * * * *